US008721125B2

(12) United States Patent
Sakai et al.

(10) Patent No.: US 8,721,125 B2
(45) Date of Patent: May 13, 2014

(54) SELF-BALLASTED LAMP AND LIGHTING EQUIPMENT

(75) Inventors: Makoto Sakai, Yokosuka (JP); Toshiya Tanaka, Yokosuka (JP); Keiichi Shimizu, Yokosuka (JP); Hitoshi Kawano, Yokosuka (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 67 days.

(21) Appl. No.: 12/788,348

(22) Filed: May 27, 2010

(65) Prior Publication Data

US 2010/0301748 A1 Dec. 2, 2010

(30) Foreign Application Priority Data

May 29, 2009 (JP) ..... 2009-130614

(51) Int. Cl.
*F21V 29/00* (2006.01)
*F21V 1/00* (2006.01)
*F21V 11/00* (2006.01)

(52) U.S. Cl.
USPC ..... 362/294; 362/235; 362/373

(58) Field of Classification Search
USPC ..... 362/294, 235
See application file for complete search history.

(56) References Cited

U.S. PATENT DOCUMENTS

| | | | | |
|---|---|---|---|---|
| 2,007,489 | A | 7/1935 | Westberg | |
| 7,226,189 | B2 * | 6/2007 | Lee et al. | 362/294 |
| 7,588,351 | B2 * | 9/2009 | Meyer | 362/294 |
| 7,670,021 | B2 * | 3/2010 | Chou | 362/148 |
| 7,800,119 | B2 * | 9/2010 | He et al. | 257/79 |
| 7,874,699 | B2 * | 1/2011 | Liang | 362/249.02 |
| 7,914,162 | B1 | 3/2011 | Huang | |
| 7,950,826 | B2 * | 5/2011 | Shin | 362/249.02 |
| 7,959,329 | B2 * | 6/2011 | Van De Ven | 362/373 |
| 7,997,750 | B2 * | 8/2011 | Chiang | 362/101 |
| 2002/0125839 | A1 | 9/2002 | Yen | |
| 2006/0067077 | A1 | 3/2006 | Kumthampinij | |
| 2006/0227558 | A1 * | 10/2006 | Osawa et al. | 362/351 |
| 2008/0084693 | A1 | 4/2008 | Shimada | |
| 2008/0089071 | A1 | 4/2008 | Wang | |

(Continued)

FOREIGN PATENT DOCUMENTS

| | | |
|---|---|---|
| DE | 202004003793 | 5/2004 |
| DE | 20 2008 016231 | 3/2009 |

(Continued)

OTHER PUBLICATIONS

English language Abstract of JP 2009-037995, published Feb. 19, 2009.

(Continued)

*Primary Examiner* — David J Makiya
(74) *Attorney, Agent, or Firm* — DLA Piper LLP (US)

(57) ABSTRACT

The invention provides a self-ballasted lamp having high heat radiation performance, which is lightweight and inexpensive. A substrate having LED elements mounted is provided at one edge side of the radiator, and a cap is provided at the other edge side the radiator. A lighting circuit is accommodated between the radiator and the cap. The radiator includes a cylindrical cover member and an annular radiation member fitted to the outer circumferential part of the cover member and is composed by combining the cover member and the radiation member together. The cover member and the radiation member are made of metal and are formed by press-working.

16 Claims, 4 Drawing Sheets

(56) References Cited

U.S. PATENT DOCUMENTS

| | | | | |
|---|---|---|---|---|
| 2008/0186704 | A1* | 8/2008 | Chou et al. | 362/249 |
| 2008/0246383 | A1 | 10/2008 | Chang | |
| 2009/0080187 | A1* | 3/2009 | Chou | 362/231 |
| 2009/0086474 | A1 | 4/2009 | Chou | |
| 2009/0296387 | A1* | 12/2009 | Reisenauer et al. | 362/235 |
| 2010/0079075 | A1 | 4/2010 | Son | |
| 2010/0096992 | A1 | 4/2010 | Yamamoto | |

FOREIGN PATENT DOCUMENTS

| | | |
|---|---|---|
| DE | 20 2009 001079 | 4/2009 |
| EP | 1772668 | 4/2007 |
| EP | 1950491 | 7/2008 |
| JP | 4-66009 | 10/1992 |
| JP | 2002-347513 | 12/2002 |
| JP | 2003-016818 | 1/2003 |
| JP | 2005-79593 | 3/2005 |
| JP | 2006-040727 | 2/2006 |
| JP | 2006-172895 | 6/2006 |
| JP | 2007-157690 | 6/2007 |
| JP | 2008-140606 | 6/2008 |
| JP | 2008-257993 | 10/2008 |
| JP | 3146172 | 10/2008 |
| JP | 2009-037995 | 2/2009 |
| JP | 2009-54989 | 3/2009 |
| JP | 2009-212367 | 9/2009 |
| KR | 10-2008-0074179 | 8/2008 |
| TW | M341161 | 9/2008 |
| TW | 200840966 | 10/2008 |
| WO | WO2006/091538 | 8/2006 |
| WO | WO 2008/146694 | 12/2008 |

OTHER PUBLICATIONS

Machine English language translation of JP 2009-037995, published Feb. 19, 2009.
English language abstract of JP 3146172 published Oct. 15, 2008.
Machine English language translation of JP 3146172 published Oct. 15, 2008.
English Language Abstract of JP 2008-140606, published Jun. 19, 2008.
English Language Machine Translation of JP 2008-140606, published Jun. 19, 2008.
Extended European Search Report issued in corresponding European Patent Application No. 09014512.9 on Feb. 15, 2010.
English Language Abstract of DE 202004003793, 2004 published May 13, 2004.
Extended European Search Report issued in EP 10001621.1 on Jun. 17, 2010.
U.S. Appl. No. 12/623,906.
English Abstract of JP 2005-79593 published Mar. 24, 2005.
English Translation of JP 2005-79593 published Mar 24, 2005.
English Abstract of JP 2009-212367 published Sep. 17, 2009.
English Translation of JP 2009-212367 published Sep. 17, 2009.
English Abstract of JP 2009-54989 published Mar. 12, 2009.
English Translation of JP 2009-54989 published Mar. 12, 2009.
U.S. Appl. No. 12/909,535.
U.S. Appl. No. 12/973,992.
English Language Abstract of JP 2008-257993 published Oct. 23, 2008.
English Language Translation of JP 2008-257993 published Oct. 23, 2008.
English Language Abstract of JP 2006-040727 published Feb. 9, 2006.
English Language Translation of JP 2006-040727 published Feb. 9, 2006.
English Language Abstract of JP 2007-157690 published Jun. 21, 2007.
English Language Translation of JP 2007-157690 published Jun. 21, 2007.
English Language Abstract of WO 2008/146694 published Dec. 4, 2008.
European Search Report issued in European Application No. 10164104.1, dated Jul. 5, 2011.
U.S. Appl. No. 12/708,564.
Chinese Office Action issued in CN 201010111283.9 issued Jun. 26, 2012.
English Language Translation of Chinese Office Action issued in CN 201010111283.9 issued Jun. 26, 2012.
U.S. Appl. No. 13/063,871.
Chinese Office Action issued in CN 99103354 mailed Aug. 14, 2012.
English Translation of Chinese Office Action issued in CN 99103354 mailed Aug. 14, 2012.
English Language Abstract of TW M341161 published Sep. 21, 2008.
English Language Abstract of TW 200840966 published Oct. 16, 2008.
Chinese Office Action issued in CN201010188500.4 mailed Aug. 20, 2012.
English Language translation of Chinese Office Action issued in CN201010188500.4 mailed Aug. 20, 2012.
English Language Office Action issued in KR 10-2011-7005579 on Jul. 27, 2012.
English Language Abstract of KR 10-2008-0074179 published Aug. 12, 2008.
Japanese Office Action issued in JP 2009-037190 on Aug. 15, 2012.
English Language Translation of Japanese Office Action issued in JP 2009-037190 on Aug. 15, 2012.
English Language Abstract of JP 4-66009 published Oct. 6, 1992.
English Language Abstract of JP 2006-172895 published Jun. 29, 2006.
English Language Translation of JP 2006-172895 published Jun. 29, 2006.
English Language Abstract of JP 2003-016818 published Jan. 17, 2003.
English Language Translation of JP 2003-016818 published Jan. 17, 2003.
English Language Abstract of JP 2002-347513 published Dec. 4, 2002.
English Language Translation of JP 2002-347513 published Dec. 4, 2002.
Partial Image File Wrapper of U.S. Appl. No. 12/708,564 electronically captured on Mar. 5, 2014 between Dec. 5, 2013 and Mar. 5, 2014.
Partial Image File Wrapper of U.S. Appl. No. 13/063,871 electronically captured on Mar. 5, 2014 between Dec. 5, 2013 and Mar. 5, 2014.

* cited by examiner

SELF-BALLASTED LAMP AND LIGHTING EQUIPMENT

INCORPORATION BY REFERENCE

The present invention claims priority under 35 U.S.C. §119 to Japanese Patent Application No. 2009-130614 filed on May 29, 2009. The contents of these applications are incorporated herein by reference in their entirety.

FIELD OF THE INVENTION

The present invention relates to a self-ballasted lamp using semiconductor light-emitting elements as its light source and lighting equipment using the self-ballasted lamp.

BACKGROUND OF THE INVENTION

Conventionally, in a self-ballasted lamp using LED elements as its light source, a substrate having LED elements mounted thereon is attached to one edge side of a radiator, and a globe is attached in a manner that the globe covers the substrate, a cap is attached to the other edge side of the radiator via an insulative member, and a lighting circuit is accommodated inside the insulative member.

For example, as described in Japanese Laid-open Patent Publication No. 2009-37995, the radiator is made of die-casted aluminum and is integrally molded so that heat of the LED elements can be efficiently conducted and radiated to the outside.

However, the shape of the radiator is restricted in a range of forms moldable by an aluminum die-casting method if the radiator of the self-ballasted lamp is made of die-casted aluminum, there is a limitation in adopting an excellent shape in regard to heat radiation performance, and there is a problem that further improvement of heat radiation performance is difficult.

In addition, where the radiator of a self-ballasted lamp is made of die-casted aluminum, other problems arise that the production cost is increased, and the weight is increased. Since the load given to lighting equipment in which the self-ballasted lamp is used is increased if the weight of the self-ballasted lamp is heavy, still another problem arises that an attempt must be made to increase the supporting strength of the lighting equipment.

The present invention was developed in view of such points, and it is therefore an object of the invention to provide a self-ballasted lamp which has a high heat radiation performance, is lightweight and inexpensive, and lighting equipment using the self-ballasted lamp.

SUMMARY OF THE INVENTION

A self-ballasted lamp according to the invention comprises a substrate having semiconductor light-emitting elements mounted on one edge side thereof, a metal-made radiator formed by press-working, at which the other edge side of the substrate is brought into contact with one edge side thereof so as to enable heat conduction heat, a cap secured at the other edge side of the radiator, and a lighting circuit accommodated between the radiator and the cap.

Thus, in comparison with a radiator made of die-casted aluminum, since the metal-made radiator is formed by press-working, the radiator can be easily formed to an excellent shape in view of heat radiation performance, wherein a self-ballasted lamp can be provided which has high heat radiation performance, is lightweight and inexpensive.

In the present invention and the following invention, the terminology and technical meanings are based on the following unless otherwise specified.

A semiconductor light-emitting element includes, for example, an LED element and an EL element. In the case of the LED elements, the semiconductor light-emitting elements may be composed as a COB (Chip On Board) module having a plurality of LED elements mounted on a substrate, or may be a module having an SMD (Surface Mount Device) package mounted on a substrate, which has one LED element mounted therein and is provided with a connection terminal.

A substrate is, for example, made to be a flat metallic material having excellent thermal conductivity such as aluminum or ceramic material, and is brought into surface contact with a radiator by means of screws or the like so as to enable heat conduction.

A radiator is formed by press-working a metallic plate, and may be composed of a single component or of an assembly which is obtained by press-working two or more components and integrally combining them together. Also, a heat conduction member for efficiently enabling heat conduction may intervene between the substrate and the radiator.

A cap which may be connected to a socket of, for example, an E17 or E26 type general illumination bulb may be used.

A lighting circuit has, for example, a power source circuit that outputs a direct current of constant current, and supplies electric power to semiconductor light-emitting elements by a predetermined feeding unit.

In addition, although a globe having translucency, which covers one edge side of the substrate, or the like, may be provided, the globe is not requisite for the configuration of the present invention.

Further, in the self-ballasted lamp according to the present invention, the radiator is provided with a cylindrical cover part having the cap secured at the other edge side, a substrate junction part secured at one edge side of the cover part, with which the surface at the other edge side of the substrate is brought into contact so as to enable heat conduction, and a radiation part thermally connected to the substrate junction part.

Thus, since the radiator has the radiation part thermally connected to the substrate junction part with which the substrate is brought into contact so as to enable heat conduction, the heat radiation performance can be improved.

The radiation part is formed to be, for example, wave-shaped so as to become convex and concave in the radial direction, has the tip end side thereof formed to be comb teeth-shaped, or is formed so as to surround substantially the entirety of the outer circumferential part of the cover part, whereby the heat radiation performance can be improved by widening the surface area.

The radiation part thermally connected to the substrate junction part includes cases where the substrate junction part and the radiation part are separately provided and are made integral with each other.

In addition, in the self-ballasted lamp according to the present invention, the radiator includes a cylindrical cover member having the cap secured at the other edge side, and an annular radiation member brought into contact with and fitted to the outer circumferential part of the cover member so as to enable heat conduction. The surface of the other edge side of the substrate is brought into contact with and provided at one edge side of at least one of the cover member and the radiation member so as to enable heat conduction.

Thus, the radiator is composed in a manner that the cylindrical cover member and the annular radiation member fitted to the outer circumferential part of the cover member are made separate, wherein the radiation member can be easily made into a shape having excellent heat radiation performance, and the heat radiation performance can be improved.

The heat conductivity may be improved by causing a heat radiation sheet, a resin material and grease or the like to intervene between the contact portions of the cover member and the heat conduction member or the heat conductivity may be improved by integrally fixing the cover member and the radiation member by welding.

The radiation member is formed to be, for example, wave-shaped, comb teeth-shaped having a plurality of slits, or formed so as to surround substantially the entirety of the outer circumferential part of the cover part, whereby the heat radiation performance can be improved by widening the surface area.

Also, lighting equipment according to the present invention includes an equipment main body having a socket; and the self-ballasted lamp attached to the socket of the equipment main body.

Therefore, the self-ballasted lamp is light in weight and the load given to the equipment main body can be reduced.

DETAILED DESCRIPTION OF THE PREFERRED EMBODIMENTS

Hereinafter, a description is given of embodiments of the invention with reference to the drawings.

Figure 1:
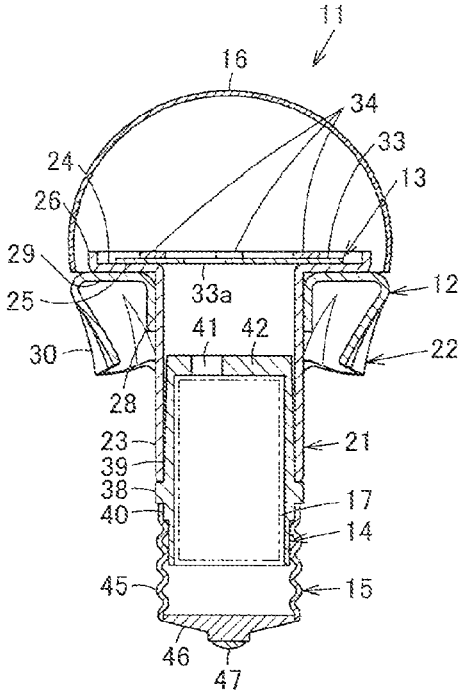
FIG. 1 is a sectional view of a self-ballasted lamp showing Embodiment 1 of the present invention.
Figure 2:
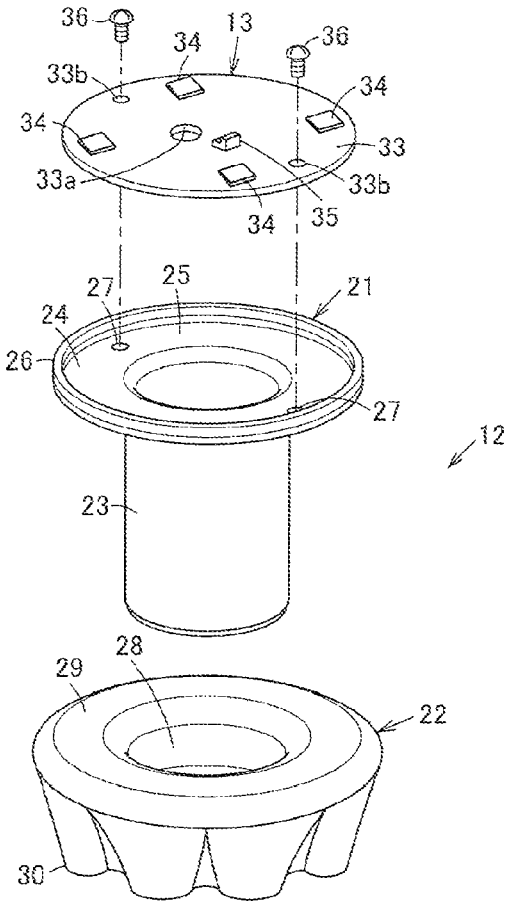
FIG. 2 is a perspective view showing a substrate and a radiator of the same self-ballasted lamp in a disassembled state.
Figure 3:
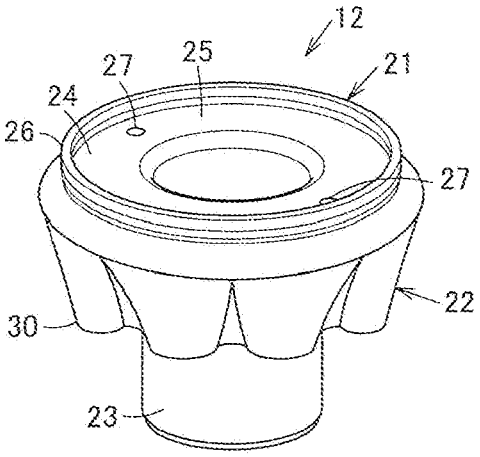
FIG. 3 is a perspective view showing the radiator of the same self-ballasted lamp in an assembled state.
Figure 4:
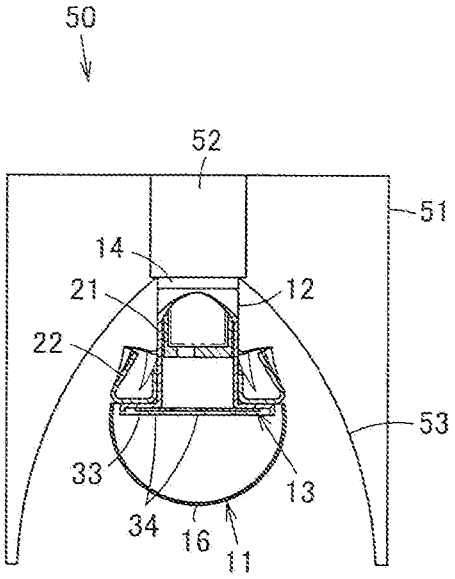
FIG. 4 is a sectional view of lighting equipment using the same self-ballasted lamp.

FIG. 1 through FIG. 4 show Embodiment 1, wherein FIG. 1 is a sectional view of a self-ballasted lamp, FIG. 2 is a perspective view showing a substrate and a radiator of the self-ballasted lamp in a disassembled state, FIG. 3 is a perspective view showing the radiator of the self-ballasted lamp in an assembled state, and FIG. 4 is a sectional view of lighting equipment using the self-ballasted lamp.

In FIG. 1, reference numeral 11 denotes a self-ballasted lamp. The self-ballasted lamp 11 includes a metal-made radiator 12, a module substrate 13 attached to one edge side (one edge side in the axial direction of the self-ballasted lamp 11) of the radiator 12, a holder 14 having an insulative property, which is attached to the other edge side of the radiator 12, a cap 15 attached to the other edge side of the holder 14, a globe 16 having translucency, which covers the module substrate 13 and is attached to one edge side of the radiator 12, and a lighting circuit 17 accommodated inside the holder 14 between the radiator 12 and the cap 15.

As shown in FIG. 1 through FIG. 3, the radiator 12 is provided with a cover member 21 and a radiation member 22, and is composed by integrally, combining the cover member 21 and the radiation member 22 together.

The cover member 21 is formed by press-working a single metal plate such as, for example, an aluminum plate, the thickness of which is approximately 3 mm thick at maximum, and has a cover part 23 which is cylindrical and has substantially the same diameter as the outer-diameter of the cap 15 and are made open through at one end and the other end thereof, and an annular flange part 24 which is bent in the outer-diametrical direction from one end of the cover part 23. The surface at one edge side of the flange part 24 is composed as a substrate junction part 25 with which the module substrate 13 is brought into contact so as to enable heat conduction, an edge portion 26 projecting from the substrate junction part 25 is formed at the circumferential edge part of the flange part 24, and a plurality of attachment holes 27 for fixing the module substrate 13 by screws are formed at the substrate junction part 25.

The radiation member 22 is formed by press-working a single metal plate such as, for example, an aluminum plate which is approximately 3 mm thick at maximum, and includes a cylindrical fitting part 28 fitted to the outer circumference of the cover part 23 of the cover member 21, an annular junction part 29 connected to the surface at the other edge side of the flange part 24, that is, the opposite surface with respect to the substrate junction part 25, and a radiation part 30 bent from the peripheral portion of the junction part 29. The radiation part 30 is formed wave-shaped to become convex and concave in the radial direction in order to increase the surface area so that the tip end side thereof is inclined toward the cap 15 side so as to approach the outer circumferential part of the cover part 23 and so as to be spaced from the outer circumferential part of the cover part 23.

And, the radiator 12 is pressure-fitted from the other edge side of the cover part 23 of the cover member 21 inward of the fitting part 28 of the radiation member 22, and is assembled to be integral with each other by connecting the flange part 24 of the cover member 21 to the junction part 29 of the radiation member 22. In an assembled state, the cover part 23 of the cover member 21 and the fitting part 28 of the radiation member 22 are fixed to each other by pressure-fitting, and the cover part 23 of the cover member 21, the fitting part 28 of the flange part 24 and the radiation member 22 and the junction part 29 are brought into surface contact with and connected to each other so as to efficiently enable heat conduction. In order to connect the cover member 21 and the radiation member 22 to each other so as to efficiently enable heat conduction, a heat conduction member such as a heat radiation sheet and grease may be caused to intervene between the junction surfaces of the cover member 21 and the radiation member 22, or the cover member 21 and the radiation member 22 may be welded to each other.

Further, the module substrate 13 includes a disk-shaped substrate 33 and LED elements 34 mounted on the mounting surface being one side of the substrate 33 and provided as a plurality of semiconductor light-emitting elements.

The substrate 33 is formed of a metallic material such as, for example, aluminum, or an insulative material such as ceramic, and a wiring pattern (not shown) to which a plurality of LED elements 34 are electrically connected is formed on the mounting surface. In the vicinity of the center part of the substrate 33, a wiring hole 33*a* through which a lead wire connected from the lighting circuit 17 to the wiring pattern is passed is formed, and a connector 35 to which a connector secured at the tip end side of the lead wire passed through the wiring hole 33*a* is connected is arranged. The connector 35 is connected to the wiring pattern of the substrate 33. Further, a plurality of insertion holes 33*b* are formed in the substrate 33. By a plurality of screws 36 being screwed in respective attachment holes 27 of the radiator 12 through the insertion holes 33*b*, the substrate 33 is fixed to the radiator 12. By the screwing, the side opposed to the mounting side of the substrate 33 is pressure-fitted so as to be brought into surface contact with the substrate junction part 25 of the radiator 12 so as to enable efficient heat conduction. In this case, also, a heat conduction member such as a heat radiation sheet and grease, which enables efficient heat conduction, may be caused to intervene between the junction surfaces of the substrate 33 and the radiator 12.

As the LED element 34, an SMD (Surface Mount Device) package with connection terminals, on which LED chips are mounted, are used. The SMD package is such that, for example, an LED chip for emitting blue-color light is disposed in a reflector, and the LED chip is sealed with a fluorescent body layer such as, for example, silicone resin having a yellow-color fluorescent body, which is pumped by a part of the blue-color light from the LED chip and emits yellow-color light, mixed therein. Therefore, the surface of the fluorescent body layer is turned into a light-emitting surface, and white-color light is emitted from the light-emitting surface. Terminals, which are soldered and connected to the substrate 33, are disposed on the lateral side of the SMD package. In addition, the package may be a COB (Chip On Board) module having a plurality of LED elements 34 mounted directly on the substrate 33 and covered with a fluorescent body layer.

Further, the holder 14 is formed to be cylindrical from a material having an insulative property such as, for example, PBT resin, and has an annular projection 38, which intervenes between the cover part 23 of the cover member 21 and the cap and insulates therebetween, formed at the outer circumferential part. The radiator fixing part 39, to which the cover part 23 of the cover member 21 is fitted and fixed, is formed on the outer circumferential part at one edge side from the projection 38, and a cap fixing part 40 having the cap 15 fitted and fixed therein is formed on the outer circumferential part at the other edge side from the projection 38. A partition wall part 42 having a wiring hole 41 through which wiring connected from the lighting circuit 17 to the substrate 33 is inserted is formed at one edge side of the holder 14, and the other edge side thereof is made open so as to accommodate the lighting circuit 17.

Also, the cap 15 is such that it can be connected to a socket of, for example, an E17 type or E26 type general illumination bulb, and the cap 15 includes a shell 45 fitted to and caulked in the holder 14, an insulation part 46 provided at the other edge side of the shell 45, and an eyelet 47 provided at the top of the insulation part 46.

Further, the globe 16 is formed of glass or synthetic resin having a light diffusion property to become spherical so as to cover the module substrate 13, and is formed so as to be substantially continued to the radiation part 30 of the radiation member 22. The globe 16 may be sealed so as to prevent dust and insects from entering, or may be made open to the outside with, for example, a ventilation filter intervening.

Still further, the lighting circuit 17 is, for example, a circuit for feeding constant current to the LED elements 34, and has a circuit substrate having a plurality of circuit elements, which compose the circuit, mounted thereon. The circuit substrate is accommodated and fixed in the holder 14. The shell 45 and the eyelet 47 of the cap 15 are electrically connected to the input side of the lighting circuit 17 by wiring, and a lead wire connected to the output side of the lighting circuit 17 is electrically connected to the wiring pattern of the substrate 33 through the wiring hole 41 of the holder 14 and the wiring hole 33*a* of the substrate 33.

In addition, FIG. 4 shows lighting equipment 50 being a downlight using a self-ballasted lamp 11. The lighting equipment 50 has an equipment main body 51 in which a socket 52 and a reflector 53 are disposed.

Thus, when an electric current is supplied with the self-ballasted lamp 11 mounted in the socket 52 of the lighting equipment 50, the lighting circuit 17 operates to supply power to the respective LED elements 34, wherein the respective LED elements 34 emit light, and the light is diffused and radiated through the globe 16.

Heat generated by lighting of the LED elements 34 is thermally conducted to the substrate 33, is further thermally conducted from the substrate 33 to the radiator 12, and is radiated from the radiator 12 into the atmosphere. That is, the heat generated by lighting of the LED elements 34 is efficiently thermally conducted in the order of the substrate 33, the substrate junction part 25 of the cover member 21, the cover part 23, the junction part 29 of the radiation member 22, and the fitting part 28, and is efficiently radiated from the cover member 21 including the radiation part 30 of the radiation member 22 and the entirety of the radiation member 22 to the atmosphere. In particular, since the radiation part 30 of the radiation member 22 secures a wider surface area by forming to be wave-shaped which becomes convex and concave in the radial direction, and secures ventilation performance with spacing provided between the radiation part 30 and the cover part 23, further efficient radiation can be brought about.

Thus, the metal-made radiator 12 is formed by press-working, the radiator 12 can be easily formed to a shape which is excellent in view of heat radiation performance, in comparison with a radiator made by die-casting, wherein it is possible to provide the self-ballasted lamp 11 having high heat radiation performance, being lightweight and inexpensive.

Since the radiator 12 thermally connects the radiation part 30 to the substrate junction part 25 with which the substrate 33 is brought into contact so as to enable heat conduction, the heat radiation performance can be improved.

Since the radiator 12 is composed so as to be divided into the cylindrical cover member 21 and the annular radiation member 22 fitted to the outer circumferential part of the cover member 21, the radiation member 22 can be easily formed to a shape which is excellent in view of heat radiation performance, wherein the heat radiation performance can be improved.

In addition, the lighting equipment 50 using the self-ballasted lamp 11 can reduce the load given to the equipment main body 51 because the self-ballasted lamp 11 is light in weight, wherein the structure can be simplified.

Figure 5:
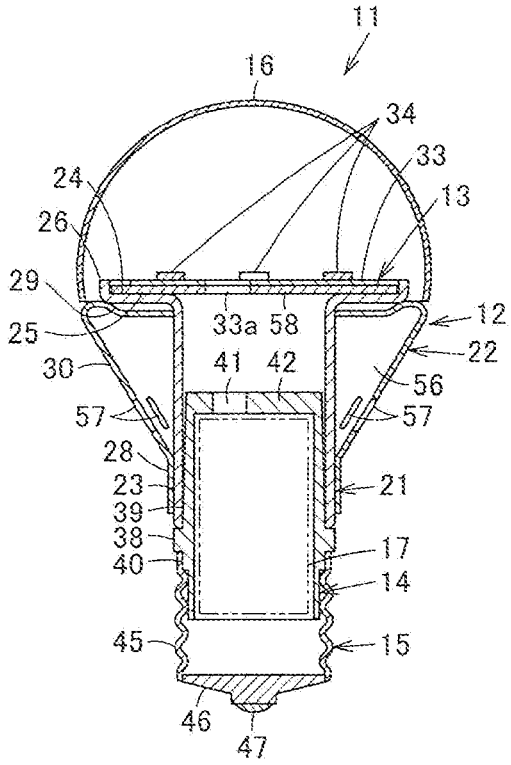
FIG. 5 is a sectional view of a self-ballasted lamp showing Embodiment 2 of the present invention.

Next, FIG. 5 shows Embodiment 2, which is a sectional view of the self-ballasted lamp.

As in Embodiment 1, the radiator 12 is composed of the cover member 21 and the radiation member 22. However, the radiation member 22 is composed of a thin metal plate which can be further easily subjected to press-working, and the fitting part 28 is fitted to the other edge side in the vicinity of the cap 15 at the outer circumferential part of the cover part 23 of the cover member 21, and the junction part 29 is connected to the side at the other edge side of the flange part 24, that is, the side opposite to the substrate junction part 25. The radiation part 30 is disposed in a conical surface shape between one edge side of the fitting part 28 and the peripheral part of the junction part 29. A spacing part 56 is formed between the radiation part 30 and the outer circumferential part of the cover part 23. The radiation part 30 is provided with a plurality of slits 57 to cause the spacing part 56 and the outside to communicate with each other.

Also, a disk-shaped substrate mounting plate 58 is connected on the flange part 24 of the cover member 21 so as to enable heat conduction, and the substrate 33 is connected to the substrate mounting plate 58 so as to enable heat conduction.

Since, in the self-ballasted lamp 11, the radiation part 30 is formed to be conical, the appearance is favorable while securing heat radiation performance.

In addition, in FIG. 5, although a part of the junction part 29 of the radiation member 22 is separated from the flange part 24 of the cover member 21 to form spacing, a heat conduction member such as a heat radiation sheet and grease, which efficiently enables connection and conduction, may be caused to intervene in the spacing, or the junction part 29 and the flange part 24 may be brought into surface contact with each other by removing the spacing.

Figure 6:
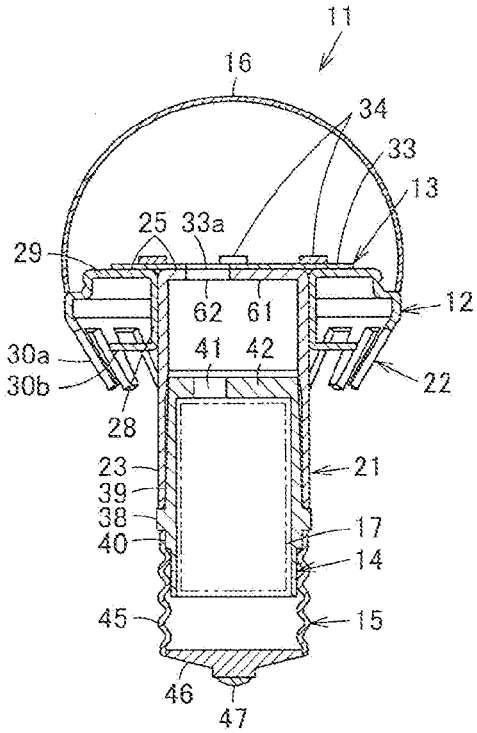
FIG. 6 is a sectional view of a self-ballasted lamp showing Embodiment 3 of the present invention.
Figure 7:
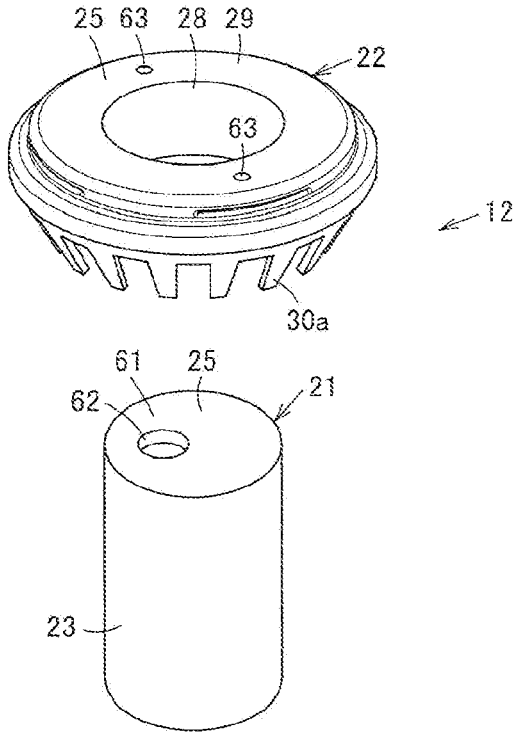
FIG. 7 is a perspective view showing the same self-ballasted lamp in a dissembled state.

Next, FIG. 6 and FIG. 7 show Embodiment 3. FIG. 6 is a sectional view of a self-ballasted lamp, and FIG. 7 is a perspective view showing a radiator of the same self-ballasted lamp in a disassembled state.

As in Embodiment 1, the radiator 12 is composed of the cover member 21 and the radiation member 22. However, a partition wall part 61 to close one edge side of the cylindrical cover part 23 is formed in the cover member 21. The partition wall part 61 composes a part of the substrate junction part 25 to which the substrate 33 is connected so as to heat conduction. In the partition wall part 61, a wiring hole 62 is formed through which a lead wire connected from the lighting circuit 17 to the wiring pattern of the substrate 33 is passed.

The radiation member 22 includes a cylindrical fitting part 28 fitted to the outer circumference of the cover part 23 of the cover member 21, an annular junction part 29 that composes a part of the substrate junction part 25 to which the substrate 33 is connected so as to enable heat conduction, an outside radiation part 30*a* bent from the surrounding part of the junction part 29, and an inside radiation part 30*b* bent from the other end of the fitting part 28. A plurality of attachment holes 63 to fix the module substrate 13 by screws are formed in the junction part 29.

The outside radiation part 30*a* is inclined toward the cap 15 side so that the tip end side thereof approaches the outer circumferential part of the cover part 23 and is formed to be comb teeth-shaped, and that the tip end side thereof is spaced from the outer circumferential part of the cover part 23, wherein the surface area is increased, and ventilation performance to the inside of the radiation member 22 is secured.

The inside of the radiation part 30*b* is such that the tip end side thereof is caused to protrude in the radial direction inward of the outside radiation part 30*a*, and is formed to be comb teeth-shaped, and is spaced from the junction part 29 and the outside radiation part 30*a*, wherein the surface area is increased, and ventilation performance to the inside of the radiation member 22 is secured.

And, the radiator 12 is pressure-fitted from one edge side of the cover part 23 of the cover member 21 to the inside of the fitting part 28 of the radiation member 22, and is assembled to be integral with the partition wall part 61 of the cover member 21 and the junction part 29 of the radiation member 22 disposed to be flush with each other. In an assembled state, the cover part 23 of the cover member 21 and the fitting part 28 of the radiation member 22 are fixed to each other by pressure-fitting, and these are brought into surface contact with and are connected to each other so as to efficiently enable heat conduction.

By a plurality of screws 36 being screwed in respective attachment holes 63 of the radiation member 22 through the substrate 33, the module substrate 13 is fixed to the radiator 12. By the screwing, the side opposite to the mounting side of the substrate 33 is pressure-fitted, in a surface contacted state, to the substrate junction part 25 composed of the partition wall part 61 of the cover member 21 and the junction part 29 of the radiation member 22, and these are connected to each other so as to enable efficient heat conduction. In this case, a heat conduction member such as a heat radiation sheet and grease to enable efficient heat conduction may be caused to intervene between the junction sides of the substrate 33 and the radiator 12.

Further, in the self-ballasted lamp 11, heat thermally conducted from the LED elements 34 to the substrate 33 is thermally conducted directly to the radiation member 22 of the radiator 12, and is further thermally conducted via the cover member 21. Furthermore, heat efficiently conducted to the radiation member 22 can be efficiently radiated outside of the radiation part 30*a* and the inside of the radiation part 30*b*, wherein the heat radiation performance is high, the temperature of the LED elements 34 can be lowered, and a longer service life can be brought about.

Also, the shapes of the outside radiation part 30*a* and the inside radiation part 30*b* are not limited to the comb teeth-shaped, and may be wave-shaped as in Embodiment 1. The point exists in securing a wider surface area, good ventilation performance, and enabling efficient heat radiation.

In addition, in the respective embodiments, although the radiator 12 is composed of two components which are the cover member 21 and the radiation member 22, and may be composed of a single component in which the cover member 21 and the radiation member 22 are integrated with each other, it may also composed of three or more components combined.

What is claimed is:

1. A self-ballasted lamp comprising:

a substrate;

semiconductor light-emitting elements mounted on a first surface of the substrate;

a metal-made radiator comprising:

a cylindrical exterior radiation part formed by press-working and comprising a wave-shaped radiation part, a cylindrical cover part with an accommodating space formed therein, and an annular flange extending from a surface of the cylindrical cover part, wherein the cylindrical exterior radiation part is in contact with the cylindrical cover part and the annular flange, and wherein a surface of the flange contacts a second surface of the substrate so as to enable heat conduction;

a cap secured at a second edge side of the radiator; and a lighting circuit accommodated between in the accommodating space of the radiation part.

2. The self-ballasted lamp according to claim 1, wherein the radiator includes:

a cylindrical cover part comprising the cap provided at the second edge side of the radiator; and a substrate junction part secured at one edge side of the cover part, with which the second surface of the substrate is brought into contact so as to enable heat conduction.

3. The self-ballasted lamp according to claim 1, wherein the radiator includes:

a cylindrical cover member wherein the cap is provided at a second edge side of the cylindrical cover member which coincides with the second edge side of the radiator; and an annular radiation member which is brought into contact with and fitted to an outer circumferential part of the cover member so as to enable heat conduction, wherein the second surface of the substrate is brought into contact with a first edge side of at least one of the cover member and the radiation member so as to enable heat conduction.

4. Lighting equipment comprising:

an equipment main body having a socket; and a self-ballasted lamp according to claim 1, which is mounted in the socket of the equipment main body.

5. The self-ballasted lamp according to claim 1, wherein part of the lighting circuit is accommodated inside the cap.

6. A self-ballasted lamp comprising:

an LED module including a substrate so as to enable heat conduction;

a metal-made radiator comprising:

a conical exterior radiation part formed by press-working of a metal plate and having a diameter which becomes smaller from a substrate side toward its opposite side, a cylindrical cover part with an accommodating space formed therein, and an annular flange extending from a surface of the cylindrical cover part, wherein the conical exterior radiation part is in contact with the cylindrical cover part and the annular flange, and wherein a surface of the flange contacts the substrate so as to enable heat conduction;

a circuit holder accommodated in the accommodating space and connected to the opposite side of the radiator;

a lighting circuit accommodated in the circuit holder and accommodated in the accommodating space together with the circuit holder; and a cap attached to the circuit holder.

7. The self-ballasted lamp according to claim 6, wherein the radiation part is formed by press-working of one single metal plate.

8. The self-ballasted lamp according to claim 6, wherein the substrate is made of a metallic material or an insulative material; and the LED module includes an LED formed on the substrate.

9. The self-ballasted lamp according to claim 6, wherein the circuit holder is cylindrical and made of an insulative resin material.

10. The self-ballasted lamp according to claim 6, wherein the circuit holder includes a partition wall part positioned between the lighting circuit and the substrate; and a wiring hole through which wiring connecting the lighting circuit and the substrate is inserted is formed in the partition wall part.

11. The self-ballasted lamp according to claim 6, wherein the substrate is brought into surface contact with the radiator.

12. The self-ballasted lamp according to claim 6, wherein the radiation part is provided with a plurality of slits.

13. Lighting equipment comprising:

an equipment main body having a socket; and a self-ballasted lamp according to claim 6, which is mounted in the socket of the equipment main body.

14. The self-ballasted lamp according to claim 6, wherein part of the lighting circuit is accommodated inside the cap.

15. A self-ballasted lamp comprising:

a substrate;

semiconductor light-emitting elements mounted on a first surface of the substrate;

a metal-made radiator comprising:

a cylindrical radiation part formed by press-working which is opened at a first and a second exterior side of the cylindrical radiation part, a cylindrical cover part with an accommodating space formed therein, and an annular flange extending from a surface of the cylindrical cover part, wherein the cylindrical radiation part is in contact with the cylindrical cover part and the annular flange, and wherein a surface of the flange contacts a second surface of the substrate so as to enable heat conduction, wherein the opening at the first exterior side of the cylindrical radiation part is covered by the second surface of the substrate;

a cap secured at a second edge side of the radiator; and a lighting circuit accommodated in the accommodating space of the radiation part.

16. The self-ballasted lamp according to claim 15, further comprising:

a circuit holder accommodated in the accommodating space and connected to the opposite side of the radiator; wherein the cylindrical radiation part comprises a conical shape part having a diameter which becomes smaller from the substrate side towards its opposite side;

the lighting circuit is accommodated in the circuit holder and accommodated in the accommodating space together with the circuit holder; and the cap is attached to the circuit holder.

* * * * *